US006840217B2

(12) United States Patent
Meiwes et al.

(10) Patent No.: US 6,840,217 B2
(45) Date of Patent: Jan. 11, 2005

(54) DEVICE FOR RESTORING A ROTARY MEMBER

(75) Inventors: Johannes Meiwes, Markgroeningen (DE); Michael Brozio, Korntal-Muenchingen (DE); Markus Michels, Stuttgart (DE); Stefan Josten, Stuttgart (DE); Reinhard Gallert, Marktredwitz (DE); Klaus Kaiser, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 87 days.

(21) Appl. No.: 10/239,511

(22) PCT Filed: Jan. 23, 2002

(86) PCT No.: PCT/DE02/00218

§ 371 (c)(1),
(2), (4) Date: Feb. 10, 2003

(87) PCT Pub. No.: WO02/063154

PCT Pub. Date: Aug. 15, 2002

(65) Prior Publication Data

US 2004/0094137 A1 May 20, 2004

(30) Foreign Application Priority Data

Jan. 23, 2001 (DE) ..... 101 02 775

(51) Int. Cl.[7] ..... F02D 7/00
(52) U.S. Cl. ..... 123/400; 123/396

(58) Field of Search ..... 123/400, 399.15, 123/337, 396, 397, 398

(56) References Cited

U.S. PATENT DOCUMENTS

| | | | | |
|---|---|---|---|---|
| 5,429,090 A | * | 7/1995 | Kotchi et al. | 123/396 |
| 5,964,203 A | * | 10/1999 | Sato et al. | 123/396 |
| 6,263,898 B1 | * | 7/2001 | Vanderveen et al. | 137/15.25 |
| 6,568,652 B2 | * | 5/2003 | Kaiser et al. | 251/69 |
| 6,691,681 B2 | * | 2/2004 | Wayama et al. | 123/399 |
| 6,745,994 B2 | * | 6/2004 | Klug et al. | 251/69 |

* cited by examiner

*Primary Examiner*—Mahmoud Gimie
(74) *Attorney, Agent, or Firm*—Ronald E. Greigg

(57) ABSTRACT

In a device for restoring a rotary member to a defined basic position, having a three-dimensionally fixed fixation cam that predetermines the basic position and having a slaving cam, which is coupled with the rotary member and is movable past the fixation cam, of which cams, each has one stop face each on sides facing away from one another, and having a clamp spring, which embraces the cams with prestressing by way of two bent-away spring legs, in order to achieve a freedom of play in rotation between the spring legs and the cams in the basic position, at least one spring leg is countersunk, with at least one leg segment, in at least one of the cams so far that in the basic position, with a leg segment fitting over the other cam, it rests without play on the stop face of the other cam.

20 Claims, 2 Drawing Sheets

DEVICE FOR RESTORING A ROTARY MEMBER

CROSS-REFERENCE TO RELATED APPLICATIONS

This application is a 35 USC 371 application of PCT/DE 02/00218, filed on Jan. 23, 2002.

BACKGROUND OF THE INVENTION

1. Field of the Invention

The invention is based on a device for restoring a rotary member to a defined basic position, in particular for restoring a throttle valve shaft, which carries a throttle valve for controlling the combustion air of an internal combustion engine, to an emergency-air position of the throttle valve, as generically defined by the preamble to claim 1.

2. Description of the Prior Art

One known restoring device, when used for a throttle valve, serves to return the throttle valve to a defined position of repose, the so-called emergency-air position or emergency-operation position, if the drive mechanism for the throttle valve fails; in this position, a minimal throttle valve opening for delivering combustion air to the engine is assured, so that the engine will still run smoothly while idling or at minimal load. Because of tolerances in the cams and the imprecision of bending the bent-away spring legs of the clamp spring, there is a certain play in the basic position, in which position the fixation cams and slaving cams are side by side, radially offset and approximately coincident, and this play leads to a freedom of rotation of the throttle valve that makes it impossible to provide precise regulation in this area.

In a known restoring device for restoring a throttle valve, disposed in a throttle valve neck in internal combustion engines (German Patent Disclosure DE 197 35 046 A1), oblique stop faces are provided in order to suppress the rotary play between the cams in the basic position of fixation cams and slaving cams. The spring leg bent away on one end of the clamp spring is retained on one side on the oblique stop faces, and the spring leg bent away on the other end of the clamp spring is retained on the other side on the level stop faces extending parallel to the axis of rotation, by fixation cams and slaving cams. Because of the oblique stop faces, the spring leg is braced on the two oblique stop faces with half the spring force each and as a result adjusts the rotatable slaving cam against the stop formed by the spring leg on the other side of the fixation cam or slaving cam.

For attaining a freedom of rotation in the slaving cam in the emergency-air position between a spring leg of the clamp spring and a stop face on one of the cams, it has already been proposed (German Patent Disclosure DE 100 13 917.5), that a compensation spring be provided, with a defined spring force oriented counter to the prestressing force of the clamp spring. The compensation spring, made as a stamped part, is fixed on one of the cams, thus placing one spring leaf in front of a stop face of the cams, which with its free end of the leaf rests with prestressing on a spring stop, disposed at a spacing from the stop face, that limits the spring travel of the spring leaf.

SUMMARY OF THE INVENTION

The restoring device of the invention has the advantage that the freedom of play between the cams and the spring legs of the clamp spring, in the basic position, is brought about without additional parts that entail expense for production and assembly, and the characteristic curve of the clamp spring is not changed. The countersinking according to the invention of the at least one leg segment of the at least one spring leg can be performed selectively on the fixation cam or the slaving cam, and in a preferred embodiment of the invention, one cam is selected for this purpose and this cam is made wider, taking maximum allowable tolerances in its width in the direction of rotation of the slaving cam, is made fundamentally wider than the other cam. It is also possible for one or both spring legs to be countersunk to a greater or lesser depth in both cams, as a result of which once again the play-free contact of the spring legs with the stop faces of the cams is achieved.

Countersinking the leg into one of the cams to bring about the freedom of play between the cams can be achieved in various ways:

In one advantageous feature of the invention, the cam receiving the leg segment has a lower softening temperature than the spring leg, and that the leg segment of the spring leg is fused, over at least part of its cross section, with the cam. Since the clamp spring rests on the cam with prestressing, the spring leg is pressed onto the stop face of the cam. If the cam is then heated to above its softening temperature, the spring force automatically presses the spring leg into the cam so far that the leg segment, extending past the stop face of the other cam, of the spring leg rests on that stop face of the other cam. Thus both spring legs are brought into contact with the total of four stop faces of the two cams, and any freedom of rotation between the cams is eliminated.

In an alternative feature of the invention, the one spring leg is embodied with a greater hardness than the cam and is stamped into the cam. The stamping is done in the basic position of the cams by means of a stamping tool placed against at least one point of the leg segment to be stamped; this tool either exerts a defined force, or it compresses the spring legs to a defined spacing. At the end of the stamping operation, here as well, both spring legs in the basic position of the cams rest without play over the total of four stop faces of the cams.

In a further feature of the invention, the fusing can be performed by heating a cam, along with the operation of stamping into the cam by a stamping tool.

BRIEF DESCRIPTION OF THE DRAWINGS

The invention is described in further detail herein below, with reference to the drawings, in which.

DESCRIPTION OF THE PREFERRED EMBODIMENTS

Figure 1:
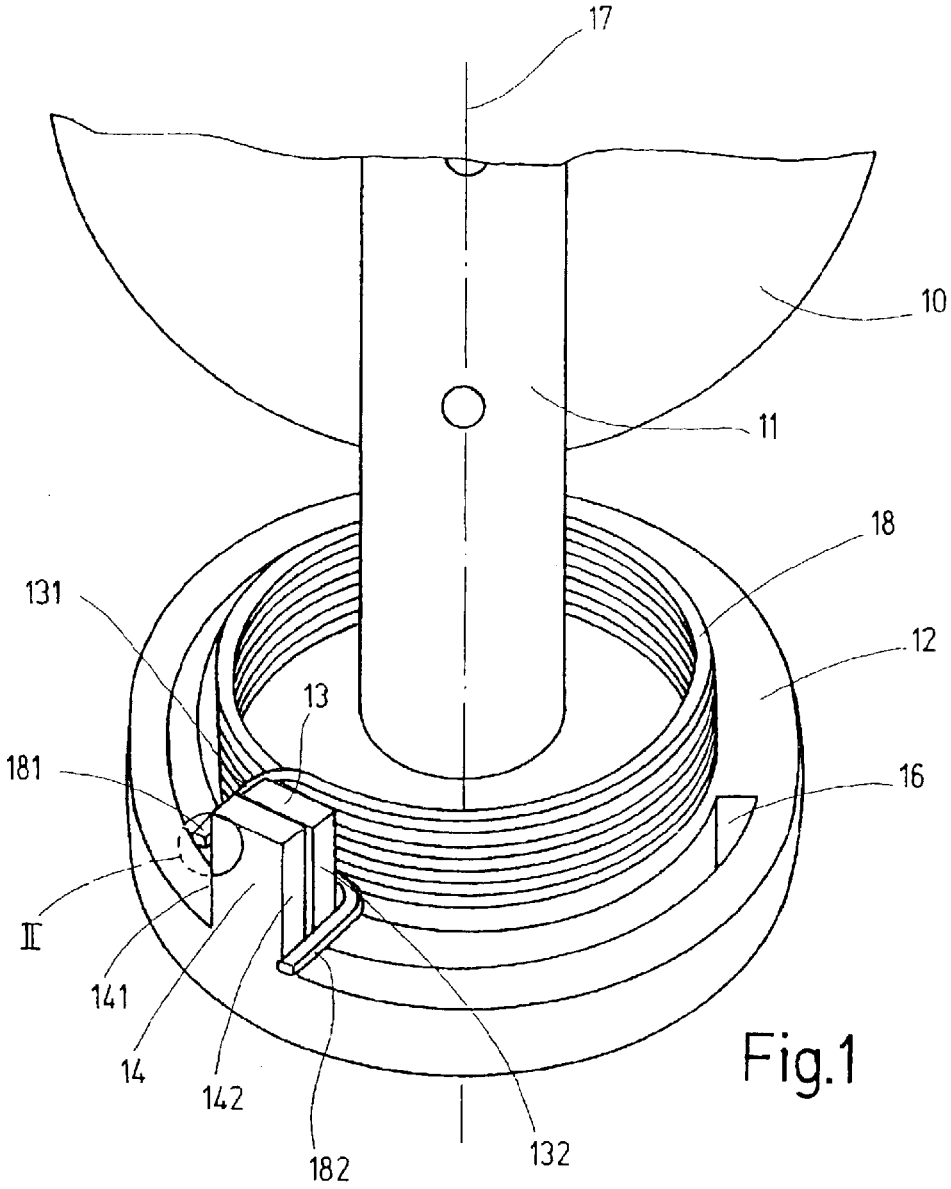
FIG. 1 is a fragmentary perspective view of a restoring device for a throttle valve.

In the device, shown in fragmentary form in perspective in FIG. 1, for restoring a rotary member to a defined basic position, the rotary member is a throttle valve shaft 11, which receives a throttle valve 10 in a manner fixed against relative rotation. In a known manner, the throttle valve 10 serving to control the combustion air of an internal combustion engine is disposed in an air intake neck, not shown here, of the engine and, by means of more or less widely opening the intake cross section in the intake neck, it controls the quantity of combustion air aspirated by the engine. The throttle valve shaft 11, for its rotation, has a slaving means 12 secured rigidly to it, which is actuated by a drive mechanism not shown here. Typically, the slaving means 12 has a toothed segment, which meshes with a gear seated on the power takeoff shaft of an electric motor. In the basic position of the rotary member, the throttle valve 10 assumes a so-called emergency-air position or emergency-operation position, in which it throttles the intake cross section in the intake neck enough that the aspirated combustion air allows only emergency operation of the engine.

Figure 5:
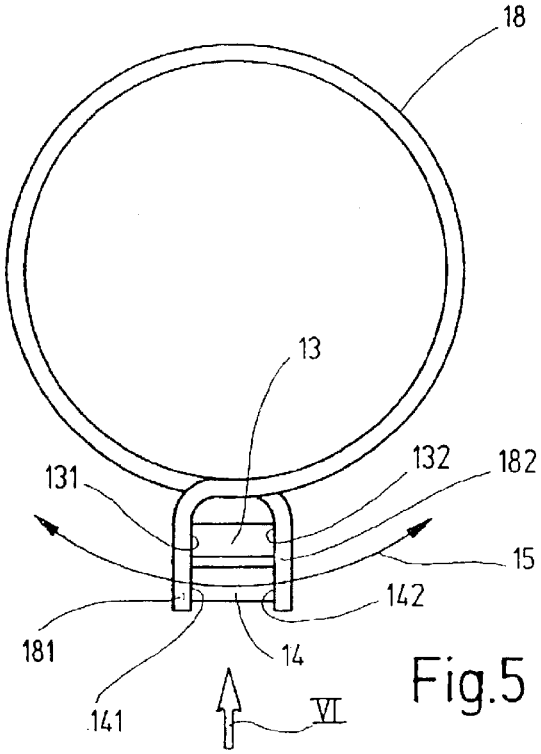
FIG. 5 is a view as in FIG. 3, after the freedom of rotation between the cams has been eliminated.

The restoring device has not only a three-dimensionally fixed fixation cam 13, which predetermines the basic position of the rotary member, that is, the throttle valve shaft 11—and thus the emergency-air position of the throttle valve 10—and which can for instance be embodied on a housing that rotatably receives the throttle valve shaft 11, but also a slaving cam 14, embodied on the slaving means 12 and disposed on the slaving means 12 in such a way that it can be moved past the fixation cam 13 in both directions of rotation, indicated in FIG. 5 by arrow 15. As can be seen from FIG. 1, the fixation cam 13 extends through a curved recess 16 in the slaving means 12 that is disposed coaxially with the axis 17 of the throttle valve shaft 11 and extends over a range of rotation of the slaving means 12. The length of the recess 16 defines the range of rotation of the slaving means 12. On both the fixation cam 13 and the slaving cam 14, on sides facing away from one another in terms of the direction of rotation, one stop face each 131, 132 and 141, 142 is formed.

The restoring device also includes a clamp spring 18, which is embodied here as a helical torsion spring, with spring legs 181, 182 bent away on the ends of the spring. The clamp spring 18 is disposed coaxially with the slaving means 12, and its spring legs 181, 182 extend transversely to the axis 17 of the slaving means 12 and of the throttle valve shaft 11. The clamp spring 18, with its spring legs 181, 182, embraces the fixation cam 13 and the slaving cam 14 with initial stress and fixes the basic position of the restoring device, from which position, by rotation of the slaving means 12 in one or the other direction of rotation, the throttle valve shaft 11 with the throttle valve 10 can be rotated, thus tensing the clamp spring 18. Each spring leg 181 and 182, in the basic position of the restoring device shown in FIG. 1, fits over one stop face 131 and 132, respectively, on the fixation cam 13 and one stop face 141 and 142, respectively, on the slaving cam 14. Upon rotation out of the basic position either the spring leg 181 or the spring leg 182, depending on the direction of rotation of the slaving means 12, is slaved by the stop face 141 or 142 of the slaving cam 14, while the other spring leg, 182 or 181, is braced on the stop face 132 or 131 of the fixation cam 13.

Figure 3:
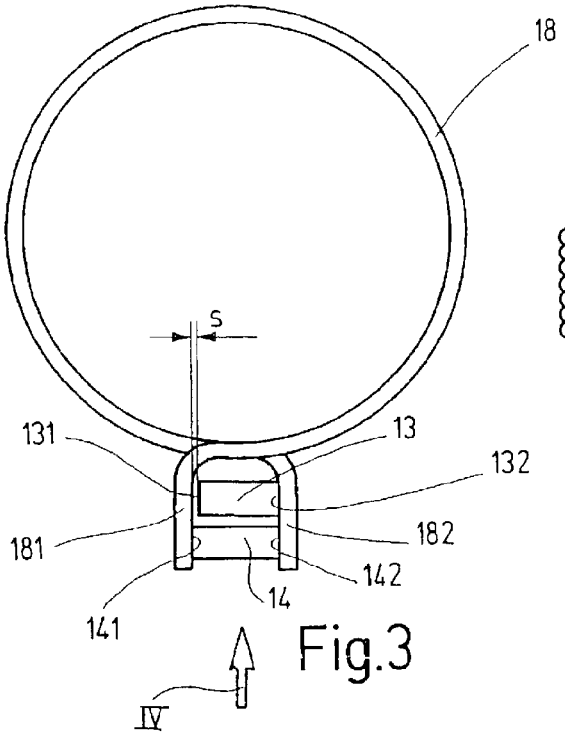
FIG. 3 is a plan view on the clamp spring and cams, located in the basic position, of the restoring device while there is still freedom of rotation between the cams.

Because of production variations, in the basic position of the restoring device, a freedom of rotation s can occur between the clamp spring 18 and the cams 13, 14, as shown in FIG. 3, if the spring legs 181 and 182 do not rest on all four stop faces 131, 132 and 141, 142 of the cams 13, 14, but instead only on three stop faces. In the exemplary embodiment shown in FIG. 3, the leg 182 of the clamp spring 18 rests on the stop faces 132 and 142 of the fixation cam 13 and slaving cam 14, and the spring leg 181 of the clamp spring 18, because the width of the fixation cam 13 is too slight, rests only on the stop face 141 of the slaving cam 14. The clamp spring 18—and thus the slaving cam 14 and the rotary member—can rotate, in the basic position, by the play s relative to the fixation cam 13.

Figure 2:
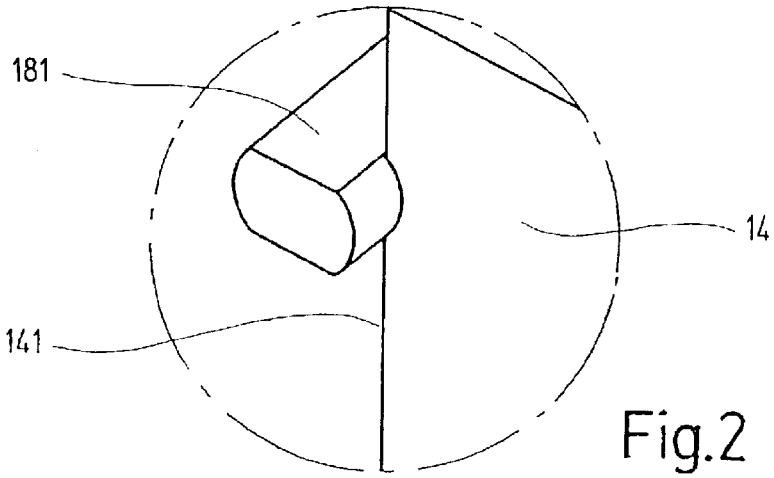
FIG. 2 is an enlarged view of the detail II in FIG. 1.

In order to eliminate this play, which is troublesome for regulating the combustion air in the emergency-air position, in the basic position of the restoring device, the spring leg 181 is countersunk, with its leg segment extending past the stop face 141 of the slaving cam 14, into the slaving cam 14 far enough that its further leg segment, adjoining this first leg segment and fitting over the fixation cam 13, rests without play on the stop face 131 of the fixation cam 13 in the basic position of the restoring device. This countersunk state of the spring leg 181 is seen in plan view in FIG. 5 and in a front view in FIG. 6. In FIG. 2, the spring leg 181 countersunk in the slaving cam 14 is shown enlarged and in perspective. In principle, the countersinking of the spring leg 181 can be done selectively in each of the two cams 13,14, depending on which cam is the one where the existing play has to be eliminated. For a defined production process, however, the particular cam, 13 or 14, that receives the leg segment is selected in advance and is embodied in terms of its width in the direction of rotation of the slaving cam 14 such that, taking maximum allowable tolerances into account, it is always wider than the other cam, 14 or 13.

Figure 4:
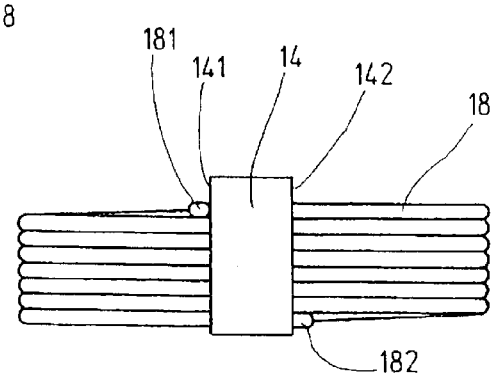
FIG. 4 is a view in the direction of arrow IV in FIG. 3.
Figure 6:
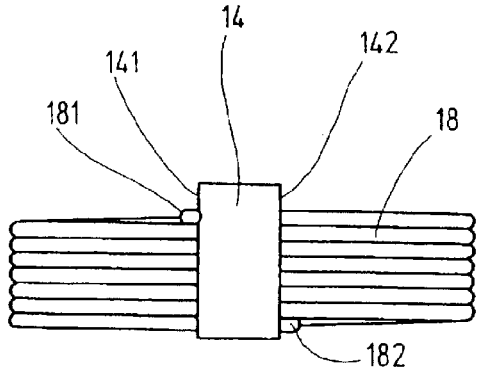
FIG. 6 is a view in the direction of arrow VI in FIG. 5.

The countersinking of the spring leg into the wider cam, that is, in the exemplary embodiment of FIGS. 1–5 of the spring leg 181 into the slaving cam 14, can be done in various ways:

The cam receiving the leg segment, that is, the slaving cam 14 in the exemplary embodiment of FIGS. 1–5, is manufactured from a material with a lower softening temperature than the spring leg 181. After assembly of the restoring device, the spring leg 182—as shown in FIGS. 3 and 4—rests under the prestressing force of the clamp spring 18 on the stop face 132 of the fixation cam 13 and on the stop face 142 of the slaving cam 14, while the spring leg 181 of the clamp spring 18 rests only on the stop 141 of the wider slaving cam 14, while relative to the stop face 131 of the narrower fixation cam 13, it has the gap spacing s. If the slaving cam 14 is now heated to above its softening temperature, the spring leg 181, pressing against the stop face 141 of the slaving cam 14 with the prestressing force of the clamp spring 18, fuses with the slaving cam 14 to such an extent that the leg 181 comes to rest, with its other leg segment, on the stop face 131 of the fixation cam 13, as is shown in FIGS. 5 and 6. Thus both spring legs 181, 182 rest on all four stop faces 131, 141, 132, 142 of the fixation cam 13 and slaving cam 14, and in the basic position of the restoring device, any play between the clamp spring 18 and the cams 13, 14 is suppressed.

The countersinking of the spring leg 181, with its leg segment that fits over the stop face 141, into the slaving means 14 can also be realized in such a way that the leg 181 is embodied with a greater hardness than the slaving cam 14 and is stamped into the slaving cam 14. The stamping is done by means of a stamping tool, which presses with a defined force on one or more points of the leg segment extending past the stop face 141 of the slaving cam 14, or presses the spring legs 181, 182 together to a defined spacing with a suitably great force. This stamping of the spring leg 181 leads to the same result as the partial countersinking of the spring leg 181 into the slaving cam 14, as shown in FIGS. 5 and 6. It is understood that it is also possible to combine the stamping operation with heating of the slaving cam 14.

The invention is not limited to the exemplary embodiment described. For instance, the fixation cam 13 and slaving cam 14 can be transposed in their position, so that the fixation cam 13 is on the outside and the slaving cam 14 is on the inside, near the clamp spring 18. The countersinking can be done with each spring leg 181 or 182 into each cam 13 or 14. If there is an extreme play s in the basic position of the restoring device, it is also possible for both spring legs 181 and 182 to be countersunk into the same cam 13 or 14 on both stop faces 131 and 132, or 141 and 142. It is also possible for both spring legs 181 and 182 to be countersunk to a greater or lesser depth into all four stop faces 131, 132, 141, 142, such that the play s is eliminated. The wire cross section of the clamp spring 18 or of the spring legs 181, 182 can have an arbitrary shape or size.

The use of the described device for restoring a rotary member is not limited to controlling the combustion air of an internal combustion engine by means of a throttle valve. For instance, the rotary member can also be a pivot shaft of an exhaust gas valve, connected solidly to it, which valve is disposed in an exhaust gas recirculation line of the engine and meters the quantity of exhaust gas delivered to the intake air of the engine.

The foregoing relates to preferred embodiments of the invention, it being understood that other variants and embodiments thereof are possible within the spirit an scope of the invention, the latter being defined by the appended claims.

What is claimed is:

1. A device for restoring a rotary member to a defined basic position, comprising a three-dimensional fixed fixation cam (13) that predetermines the basic position, a slaving cam (14), which is coupled with the rotary member and is movable past the fixation cam (13), said cams (13, 14), each having one stop face (131, 132, 141, 142) each on sides facing away from one another, and a clamp spring (18) which embraces the cams (13, 14) with prestressing by way of two bent-away spring legs (181, 182) each reaching past the stop faces (131, 132, 141, 142) of the cams (13, 14), at least one spring leg (181) having at least one leg segment countersunk in at least one of the cams (14) so far that in the basic position, with a leg segment fitting over the other cam (13), it rests without play on the stop face (131) of the other cam (13).

2. The device of claim 1 wherein the cam (14) receiving the leg segment has a lower softening temperature than the spring leg (181), and wherein the leg segment of the spring leg (181) is fused, over at least part of its cross section, with the cam (14).

3. The device of claim 2 wherein the fusing is accomplished by heating.

4. The device of claim 1 wherein the at least one spring leg (181) is embodied with a greater hardness than the cam (14) and is stamped into the cam (14).

5. The device of claim 2 wherein the at least one spring leg (181) is embodied with a greater hardness than the cam (14) and is stamped into the cam (14).

6. The device of claim 3 wherein the at least one spring leg (181) is embodied with a greater hardness than the cam (14) and is stamped into the cam (14).

7. The device of claim 4 wherein the stamping is accomplished by a stamping tool placed against at least one point of the leg segment.

8. The device of claim 7 wherein the stamping tool engages the leg segment with a defined force.

9. The device of claim 7 wherein the stamping tool compresses the spring legs (181, 182) to a defined spacing.

10. The device of claim 1 wherein the cam (14) receiving the leg segment is embodied with a width, via in the direction of rotation of the slaving cam (14), that is greater than the width of the other cam (13), taking allowable tolerances into account.

11. The device of claim 2 wherein the cam (14) receiving the leg segment is embodied with a width, via in the direction of rotation of the slaving cam (14), that is greater than the width of the other cam (13), taking allowable tolerances into account.

12. The device of claim 3 wherein the cam (14) receiving the leg segment is embodied with a width, via in the direction of rotation of the slaving cam (14), that is greater than the width of the other cam (13), taking allowable tolerances into account.

13. The device of claim 4 wherein the cam (14) receiving the leg segment is embodied with a width, via in the direction of rotation of the slaving cam (14), that is greater than the width of the other cam (13), taking allowable tolerances into account.

14. The device of claim 9 wherein the cam (14) receiving the leg segment is embodied with a width, via in the direction of rotation of the slaving cam (14), that is greater than the width of the other cam (13), taking allowable tolerances into account.

15. The device of claim 1 wherein the clamp spring (18) is embodied as a cylindrical helical torsion spring and is disposed coaxially to the rotary member.

16. The device of claim 10 the clamp spring (18) is embodied as a cylindrical helical torsion spring and is disposed coaxially to the rotary member.

17. The device of claim 1 employed for controlling an internal combustion engine.

18. The device of claim 17 wherein the rotary member is connected to an exhaust gas valve in an exhaust gas recirculation line of the engine.

19. The device of claim 17 wherein the rotary member is connected to a throttle valve (10) in an air intake neck of the engine.

20. The device of claim 19 wherein the basic position of the rotary member is equivalent to an emergency-operation position of the engine.

* * * * *

UNITED STATES PATENT AND TRADEMARK OFFICE

CERTIFICATE OF CORRECTION

PATENT NO. : 6,840,217 B2
DATED : January 11, 2005
INVENTOR(S) : Johannes Meiwes et al.

It is certified that error appears in the above-identified patent and that said Letters Patent is hereby corrected as shown below:

Title page,
Item [56], References Cited, U.S. PATENT DOCUMENTS, please add the following:
-- 5,131,364 A 7/1992 Mann.....123/399
5,492,097 A 2/1996 Byram et al. .....123/396 --
FOREIGN PATENT DOCUMENTS, please add the following:
-- DE 39 18 852 A 12/1990
DE 100 13 917 A 9/2001
EP 0 523 432 A 1/1993 --

Signed and Sealed this

Nineteenth Day of April, 2005

JON W. DUDAS
*Director of the United States Patent and Trademark Office*